US007522477B1

(12) United States Patent
Sheldon

(10) Patent No.: US 7,522,477 B1
(45) Date of Patent: Apr. 21, 2009

(54) MULTI-EVENT TIMER DEVICE

(76) Inventor: Gregory Scott Sheldon, 421 Greenwood Dr., Woodland, CA (US) 95695

( * ) Notice: Subject to any disclaimer, the term of this patent is extended or adjusted under 35 U.S.C. 154(b) by 14 days.

(21) Appl. No.: 11/432,359

(22) Filed: May 10, 2006

(51) Int. Cl.
*G04C 11/00* (2006.01)

(52) U.S. Cl. ..... 368/46; 368/10

(58) Field of Classification Search ..... 368/109, 368/46, 96
See application file for complete search history.

(56) References Cited

U.S. PATENT DOCUMENTS

| | | | | |
|---|---|---|---|---|
| 3,877,216 | A | 4/1975 | Mounce et al. | |
| 4,005,571 | A | 2/1977 | Wolff | |
| 4,123,896 | A | 11/1978 | Asano et al. | |
| 4,255,805 | A | 3/1981 | Jaunin | 368/108 |
| 4,423,734 | A | 1/1984 | Schawel | 128/460 |
| 4,490,711 | A | 12/1984 | Johnston | 340/309.4 |
| 4,505,595 | A | 3/1985 | Rose et al. | 368/110 |
| 4,523,857 | A * | 6/1985 | Ushikoshi | 368/109 |
| 4,588,303 | A | 5/1986 | Wirtschafter et al. | 368/10 |
| 4,715,385 | A | 12/1987 | Cudahy et al. | 128/710 |
| 4,853,844 | A | 8/1989 | Kono | |
| 4,905,213 | A | 2/1990 | Masse et al. | 368/10 |
| 4,972,391 | A | 11/1990 | Juve et al. | 368/10 |
| 4,975,842 | A | 12/1990 | Darrow et al. | |
| 5,088,056 | A | 2/1992 | McIntosh et al. | |
| 5,088,070 | A | 2/1992 | Shiff | 368/10 |
| 5,097,429 | A | 3/1992 | Wood et al. | |
| 5,099,463 | A | 3/1992 | Lloyd et al. | 368/10 |
| 5,157,640 | A | 10/1992 | Backner | 368/10 |
| 5,291,399 | A | 3/1994 | Chaco | |
| 5,307,263 | A | 4/1994 | Brown | |
| 5,337,290 | A | 8/1994 | Ventimiglia et al. | 368/10 |
| 5,365,496 | A | 11/1994 | Tolan-Samilow | 368/109 |
| 5,408,443 | A | 4/1995 | Weinberger | 368/10 |
| 5,487,276 | A * | 1/1996 | Namisniak et al. | 62/125 |
| 5,495,961 | A | 3/1996 | Maestre | 221/3 |
| 5,691,932 | A | 11/1997 | Reiner et al. | 368/10 |
| 6,886,139 | B2 | 4/2005 | Liu | 715/864 |
| 7,061,832 | B1 * | 6/2006 | Lansing | 368/10 |
| 7,187,624 | B2 * | 3/2007 | Terzian et al. | 368/69 |
| 2005/0243655 | A1 * | 11/2005 | McCutcheon et al. | 368/107 |
| 2005/0283327 | A1 * | 12/2005 | Bowman et al. | 702/81 |

OTHER PUBLICATIONS www.itzbeen.com—Coast Innovations—copy from Jan. 10, 2008.*
www.m-w.com/dictionary/icon—definition of "icon".*

* cited by examiner

*Primary Examiner*—Renee S Luebke
*Assistant Examiner*—Jason Collins
(74) *Attorney, Agent, or Firm*—Haverstock & Owens LLP

(57) ABSTRACT

A multiple-event timer device for timing various infant-related biological functions such as diaper changes, feeding and sleeping is described herein. The timer device has a plurality of digital timers corresponding to a plurality of displays and a plurality of buttons. Each timer, display and button grouping functions independently. Each button includes an icon and/or is shaped to designate an event associated with that button. To reset a timer, its corresponding button is pressed-and-released. Each timer has an independent programmable upper limit or alarm setpoint. If the upper limit for a given timer is reached, an LED behind the associated button is illuminated. In some embodiments, audible alarms are activated. To set an alarm setpoint, the appropriate button is depressed and held, then the same button is pressed-and-released until the desired setpoint is reached. The timer device allows a user to monitor a plurality of events simultaneously.

46 Claims, 4 Drawing Sheets

MULTI-EVENT TIMER DEVICE

FIELD OF THE INVENTION

The present invention relates to the field of timer devices. More specifically, the present invention relates to timer devices for timing health-related functions.

BACKGROUND OF THE INVENTION

When a baby is crying, there are numerous possible reasons, yet it is difficult to pinpoint which one is the cause for the crying. Parents must attempt to determine if the crying stems from the baby's urge to be fed, need of a diaper change, desire to go to sleep or something else. Even when the baby is not crying, if multiple people are taking care of the baby, they must be synchronized as to when events have occurred; otherwise, the baby may go too long without certain needs being fulfilled. Although writing everything down is a possible attempt at handling such a situation, it has many drawbacks such as being inconvenient and cumbersome to use, particularly when away from home. Additionally, it is easy to forget to write something down, especially when multiple tasks are required, and they happen day after day.

U.S. Pat. No. 5,691,932 to Reiner et al. discloses a care giver data collection and events reminder system for infants. Information such as feeding times, amounts of consumption or discharge, bowel movements and other events are recorded. Specifically, the data related to when an event occurs is recorded, such as at 11:30 AM, there was a feeding of 4 oz. Based on these recorded events, alarms are able to be set for notifications of future events, such as to feed the baby at 2:30 AM. Icons within a single Liquid Crystal Display (LCD) display are used to permit international use and to simplify the operation of the device. There are numerous buttons of the device which are nondescript. The buttons include one for Mode, Time, Alarm, Amount, Record, and Left/Right/Increment/Decrement. Since there is a single LCD display capable of only showing one type of information at a time, the Mode button is required to toggle back and forth between different modes such as feeding, diaper changing and sleeping. Thus, it is impossible to view the information simultaneously, requiring a user to search for the pertinent information. Furthermore, the time information is displayed in a regular clock format, requiring a user to figure out how long it has been since the last event occurred.

SUMMARY OF THE INVENTION

A multiple-event timer device for timing various infant-related biological functions such as diaper changes, feeding and sleeping is described herein. The timer device has a plurality of digital timers corresponding to a plurality of displays and a plurality of buttons. Each timer, display and button grouping functions independently. Each button includes an icon and/or is shaped to designate an event associated with that button. To reset a timer, its corresponding button is pressed-and-released. Each timer has an independent programmable upper limit or alarm setpoint. If the upper limit for a given timer is reached, an LED behind the associated button is illuminated. In some embodiments, audible alarms are activated. To set an alarm setpoint, the appropriate button is depressed and held, then the same button is pressed-and-released until the desired setpoint is reached. The timer device allows a user to monitor a plurality of events simultaneously.

In one aspect, a timer device comprises a plurality of timers, a plurality of displays coupled to the plurality of timers for displaying information and a plurality of buttons coupled to the plurality of displays and the plurality of timers for modifying the plurality of timers, wherein the plurality of buttons each represent a function. The timer device further comprises a switch on the timer device for indicating which breast was last used for feeding. The timer device further comprises an apparatus for attaching the timer device to another object wherein the apparatus is selected from the group consisting of a clip and a watch band. The timer device further comprises a wide bottom for enabling the timer device to stand upright. Each of the plurality of buttons are shaped according to the function represented. A first button of the plurality of buttons is shaped to represent feeding, a second button of the plurality of buttons is shaped to represent sleeping and a third button of the plurality of buttons is shaped to represent diaper changes. An icon is on or near each of the plurality of buttons according to the function represented. A first icon represents feeding, a second icon represents sleeping and a third icon represents diaper changes. Text is on or near each of the plurality of buttons according to the function represented. An alarm setpoint is selectively set within each of the plurality of timers for alerting a user. A button of the plurality of buttons corresponding to a timer of the plurality of timers of the alarm setpoint illuminates when the alarm setpoint is reached. An audible alarm sounds when an alarm setpoint is reached. The timer device further comprises a light source. The timer device further comprises a receiver for monitoring a baby's sounds. The timer device further comprises a backlight for illuminating the plurality of displays in the dark. The plurality of timers are up-count timers. A button of the plurality of buttons corresponds with one timer of the plurality of timers and one display of the plurality of displays. The plurality of displays are visible simultaneously. The plurality of displays are included within a single display device. The display device is a liquid crystal display device.

In another aspect, a timer device comprises a plurality of up-count timers, a plurality of displays coupled to the plurality of timers for displaying time-related information, a plurality of buttons coupled to the plurality of displays and the plurality of timers for modifying the plurality of timers, wherein the plurality of buttons each contain a feature representing a function and an alarm setpoint corresponding to each of the plurality of timers for alerting a user when the alarm setpoint is reached. The timer device further comprises a switch on the timer device for indicating which breast was last used for feeding. The timer device further comprises an apparatus for attaching the timer device to another object wherein the apparatus is selected from the group consisting of a clip and a watch band. The timer device further comprises a wide bottom for enabling the timer device to stand upright. The feature on each of the plurality of buttons is the shape of the button. A first button of the plurality of buttons is shaped to represent feeding, a second button of the plurality of buttons is shaped to represent sleeping and a third button of the plurality of buttons is shaped to represent diaper changes. The feature on each of the plurality of buttons is an icon. A first icon represents feeding, a second icon represents sleeping and a third icon represents diaper changes. The feature on each of the plurality of buttons is text. A button of the plurality of buttons corresponding to a timer of the plurality of timers of the alarm setpoint illuminates when the alarm setpoint is reached. An audible alarm sounds when the alarm setpoint is reached. The timer device further comprises a light source. The timer device further comprises a receiver for monitoring a baby's sounds. The timer device further comprises a backlight for illuminating the plurality of displays in the dark. A button of the plurality of buttons corresponds with one timer of the plurality of timers and one display of the plurality of displays. The plurality of displays are visible simultaneously. The plurality of displays are included within a single display device. The display device is a liquid crystal display device.

In yet another aspect, a method of utilizing a timer device comprises selectively setting one or more alarm setpoints on a plurality of timers, each timer corresponding to an event, monitoring a plurality of displays each corresponding to a timer to determine how much time passed since each of the events and individually resetting the timers after the corresponding event occurs. Setting the one or more alarm setpoints further comprises pressing a button, holding the button for a period of time, releasing the button and press-and-releasing the button until a desired alarm setpoint is reached. The method further comprises indicating which breast was last used for feeding using a switch. A button corresponding to each timer is shaped representing an event and is used for selectively setting the one or more alarm setpoints and for individually resetting the timers. A button corresponding to each timer contains an icon and is used for selectively setting the one or more alarm setpoints and for individually resetting the timers.

DETAILED DESCRIPTION OF THE PREFERRED EMBODIMENT

Figure 1A:
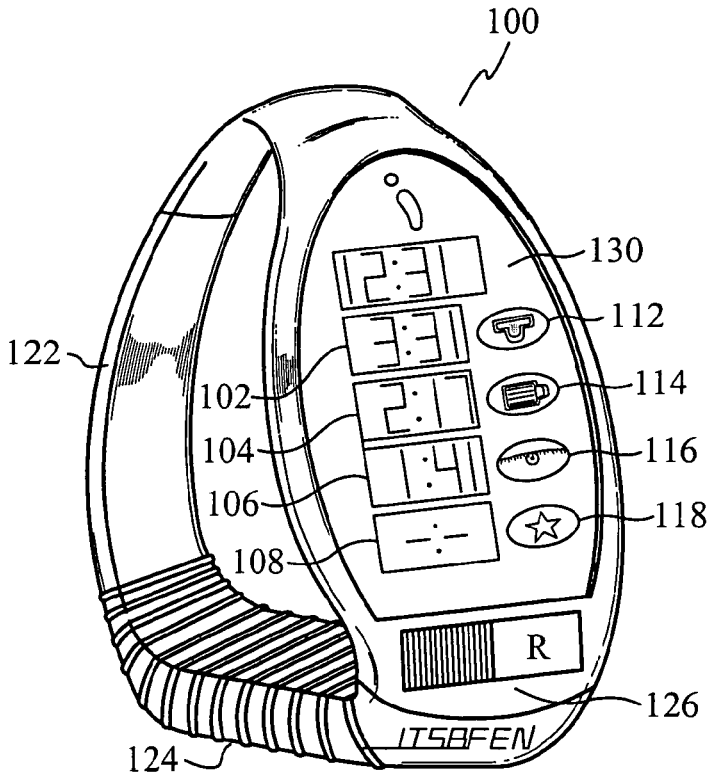
FIG. 1A illustrates a perspective view of the preferred embodiment of the present invention.

The present invention is a multiple-event timer device for timing various infant-related biological functions such as diaper changes, feeding and sleeping. The timer device has a plurality of digital timers corresponding to a plurality of displays and a plurality of buttons. In the preferred embodiment, the plurality of displays are all displayed on a single Liquid Crystal Display (LCD) capable of displaying a plurality of times where each time is separated by a piece of material. In other embodiments, the plurality of displays are a plurality of separate LCDs. In any embodiment, a user is able to see information related to a plurality of functions or events simultaneously. Each timer, display and button grouping functions independently from the other timer, display and button groupings. The buttons are preferably composed of a translucent material and either have an icon or text imprinted on them or are shaped as an icon. In other embodiments, the icon or text is imprinted near the buttons. The timers are count-up timers, meaning they increment time and do not decrement time. Furthermore, they measure elapsed time and not standard clock time. When a button is pressed, the associated timer resets to 00:00 (hh:mm) and immediately begins counting up again. In some embodiments, if the maximum time on the timer is reached, for example, 19:59, the timer stops and does not reset to 00:00.

Each timer has an independent programmable upper limit or alarm setpoint. If the upper limit for a given timer is reached, a Light Emitting Diode (LED) behind the associated button is illuminated. In some embodiments, audible alarms are activated. When an audible alarm is included, a method of turning off the audible alarm is included as well, so a user is able to implement only the visual alarm if desired. Other parts of the timer device are able to be illuminated as well in other embodiments, for example the entire frame of the timer device is translucent, and one or more LEDs illuminate the entire device. To program the upper limit for a given timer, a user presses and holds the button for a set period of time (e.g. 3 seconds) and then releases. The currently stored upper limit setpoint for that timer begins to flash on the associated LCD. For each additional press-and-release of the button, the time increases by designated increments (e.g. 30 minutes), up to a maximum time (e.g. 12:00). After the maximum time is reached, the setpoint returns to the minimum, 00:00. When the minimum is set, the alarm is disabled. In some embodiments, the LCD will read 0:FF to indicate the alarm is off. After the user stops pressing the button, the setpoint will continue to flash for a few more seconds (e.g. 3 seconds). After the period of inactivity passes, the timer returns to its up-count timing routine, beginning at 00:00. In some embodiments, setting the alarm setpoint does not reset the timer and the timer resumes its current up-count time. The timer device also includes a mechanical slide or switch to allow the user to mark which breast was last used to feed the baby. This indicator includes a notation L, corresponding to left, and a notation R, corresponding to right.

Figure 2:
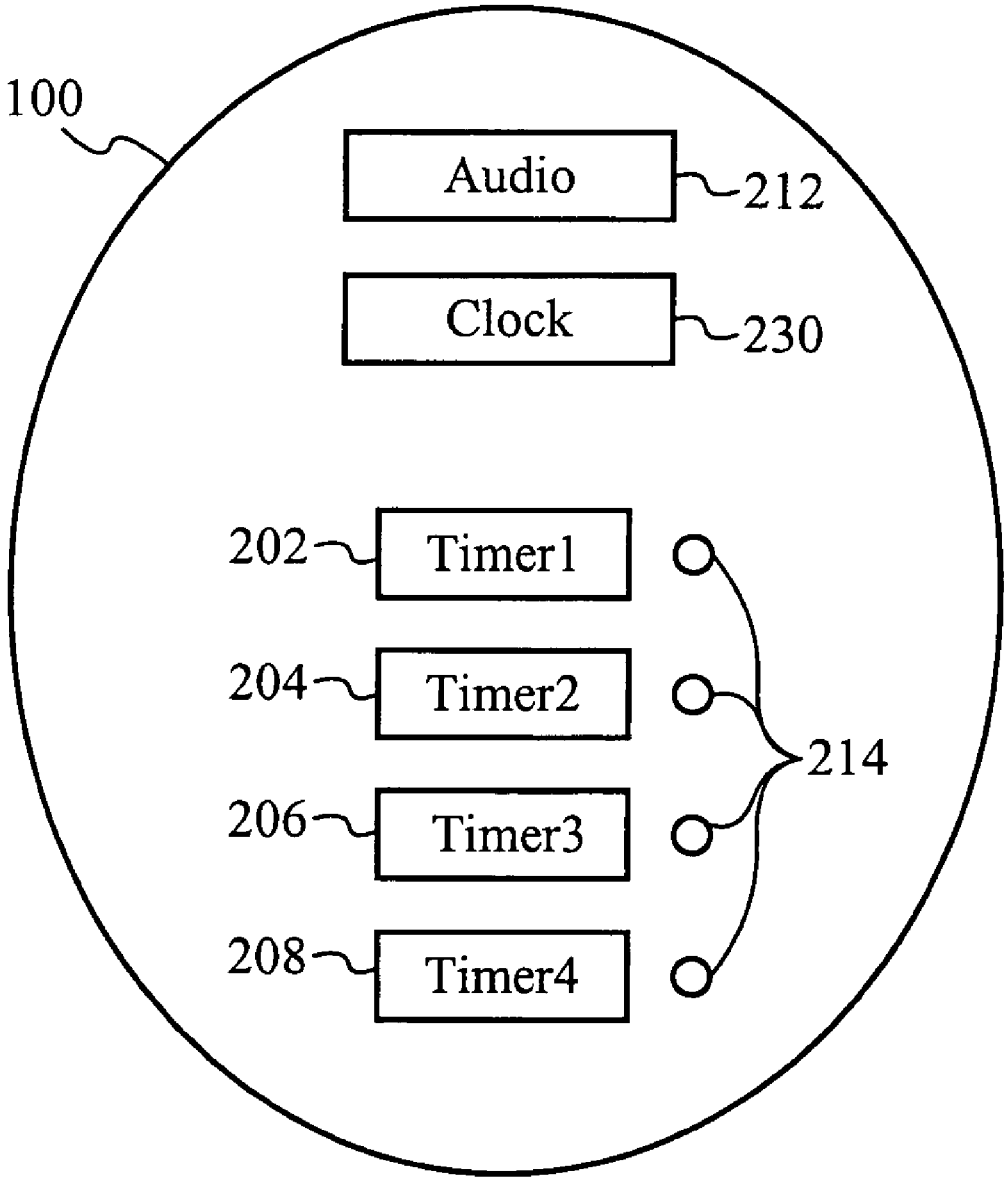
FIG. 2 illustrates a graphical representation of the internal components of the preferred embodiment of the present invention.

FIG. 1A illustrates a perspective view of the preferred embodiment of the present invention. A timer device 100 includes a plurality of displays 102, 104, 106 and 108 wherein each display has a single, dedicated button 112, 114, 116 and 118 for simple timer control. A first display 102 corresponds with a first button 112, a second display 104 corresponds with a second button 114, a third display 106 corresponds with a third button 116 and a fourth display 108 corresponds with a fourth button 118. Furthermore, coupled to each display and button is a timer 202, 204, 206, 208 (FIG. 2). As an example, a first timer 202 (FIG. 2) corresponding with the first display 102 and the first button 112 is used to track diaper changes, a second timer 204 (FIG. 2) corresponding with the second display 104 and the second button 114 is used to track feeding, a third timer 206 (FIG. 2) corresponding with the third display 106 and the third button 116 is used to track sleeping and a fourth timer 208 (FIG. 2) corresponding with the fourth display 108 and the fourth button 118 is used to track a miscellaneous use such as medications.

In some embodiments, the buttons 112, 114, 116, 118 are shaped as specified icons, such as a diaper-shaped button. In other embodiments, the buttons have icons imprinted, while the buttons are of a standard geometric shape or are also shaped as the icon. Each of the timers operate independently and continuously count up, counting elapsed time. When the user depresses one of the buttons 112, 114, 116 and 118 and releases, the associated timer resets to 00:00 (hh:mm) and immediately begins counting up again. Since the timer device 100 displays elapsed time, a user is able to instantly see how long it has been since the last event took place. Moreover, since each event is monitored with a separate display, and all of the displays are visible at the same time, a user is able to obtain different event information at once. This keeps the user informed of everything rather than having to toggle among numerous screens to find information. The user is also able to set an upper limit time for each of the timers, such as an alarm setpoint. If the alarm setpoint is reached for a given timer, an LED 214 (FIG. 2) behind the associated button is illuminated and in some embodiments an audible alarm from an audio device 212 (FIG. 2) is emitted.

In addition to the displays 102, 104, 106 and 108 with their corresponding timers, a clock 130 is optionally included within the device for telling time. The clock 130 is set using an additional button (not shown). A slide-switch 126 is utilized to indicate which breast, left or right, was used for feeding most recently.

In some embodiments, the back of the timer device 100 includes a clip 122. The clip permits a user to attach the timer device 100 to a stroller, crib, infant carrier, diaper bag, doorknob, pant loop or wherever practical to keep the timer device 100 close to the baby to prevent a user from forgetting or misplacing it. A rubberized wide bottom 124 allows a user to prop up the timer device 100 on a flat surface such as a changing table, dresser or night stand.

Figure 1B:
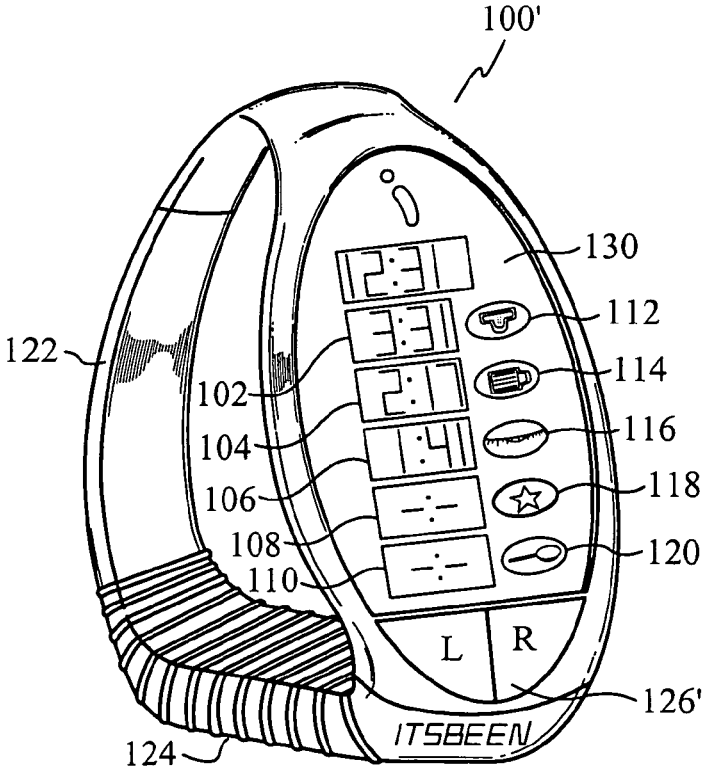
FIG. 1B illustrates a perspective view of an alternative embodiment of the present invention.

FIG. 1B illustrates a perspective view of an alternative embodiment of the present invention. A timer device 100' in an alternative embodiment is similar to the preferred embodiment, but additional functions or events are able to be monitored. In other embodiments, less functions are monitored. The timer device 100' includes the plurality of displays 102, 104, 106 and 108 with the single, dedicated buttons 112, 114, 116 and 118 for simple timer control. In addition to the displays and buttons previously described, the timer device 100' includes a fifth display 110 with a corresponding fifth button 120 along with an additional timer (not shown) for keeping track of medications, thus allowing the display 108 and button 118 to be used for another miscellaneous item such as how long it has been since the baby has cried. An over-center switch 126' is implemented to indicate which breast was last used for feeding. The over-center switch 126' is utilized by pressing the side of the switch 126' that corresponds with the correct breast, L for left and R for right.

FIG. 2 illustrates a graphical representation of the internal components of the preferred embodiment of the present invention. The plurality of timers 202, 204, 206 and 208 are coupled to the respective plurality of displays (FIG. 1A) and the respective plurality of buttons (FIG. 1A). A clock timer 230 is also optionally included. Sounds, music, voices and other audio are able to be output from an audio output device 212. The audio output device 212 is triggered when an alarm setpoint is reached thus activating the alarm. The audio is able to be turned off if desired. A plurality of LEDs 214 are positioned behind the plurality of buttons (FIG. 1A) so that when the alarm setpoint is reached, the corresponding LED is turned on, thus illuminating the button.

Figure 3:
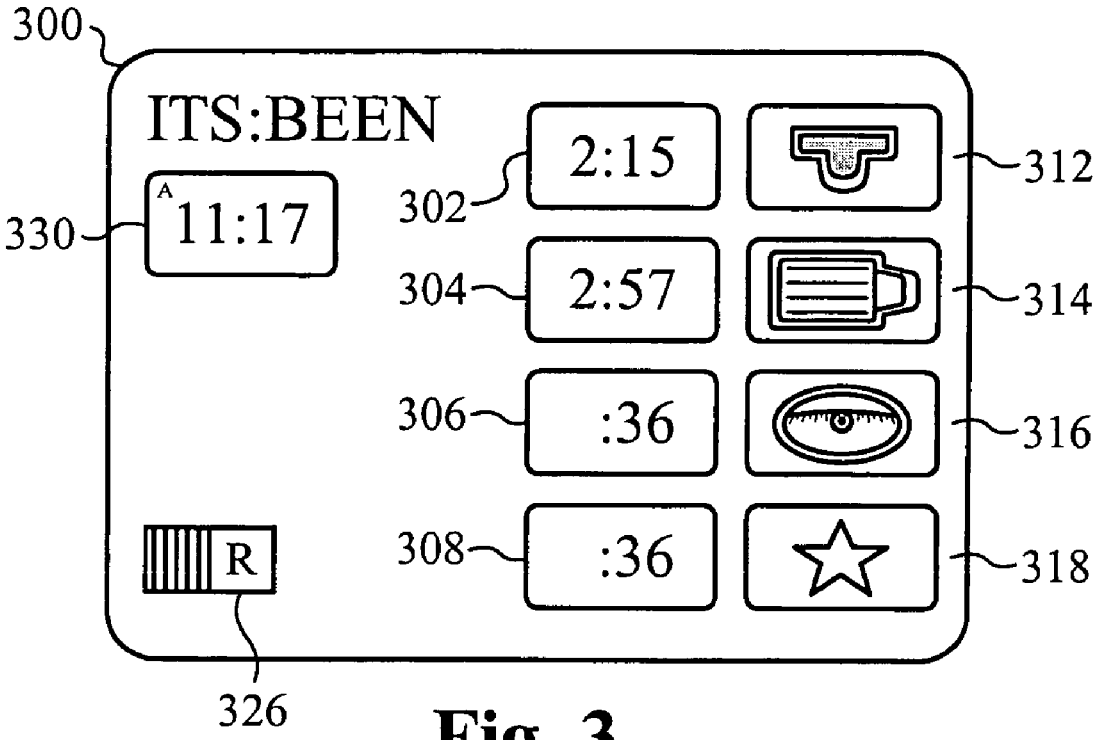
FIG. 3 illustrates a front view of an alternative embodiment of the present invention.

FIG. 3 illustrates a front view of an alternative embodiment of the present invention. In an alternative embodiment, a timer device 300 is shaped substantially rectangular and appears similar to an alarm clock. As described above, there are a plurality of timers with corresponding displays 302, 304, 306 and 308 and corresponding buttons 312, 314, 316 and 318. An optional clock 330 is included as well. A slide-switch 326 is utilized to indicate which breast, left or right, was used for feeding most recently. Although structural differences are emphasized in this alternative embodiment, the functionality is substantially similar to that of the preferred embodiment.

Figure 4:
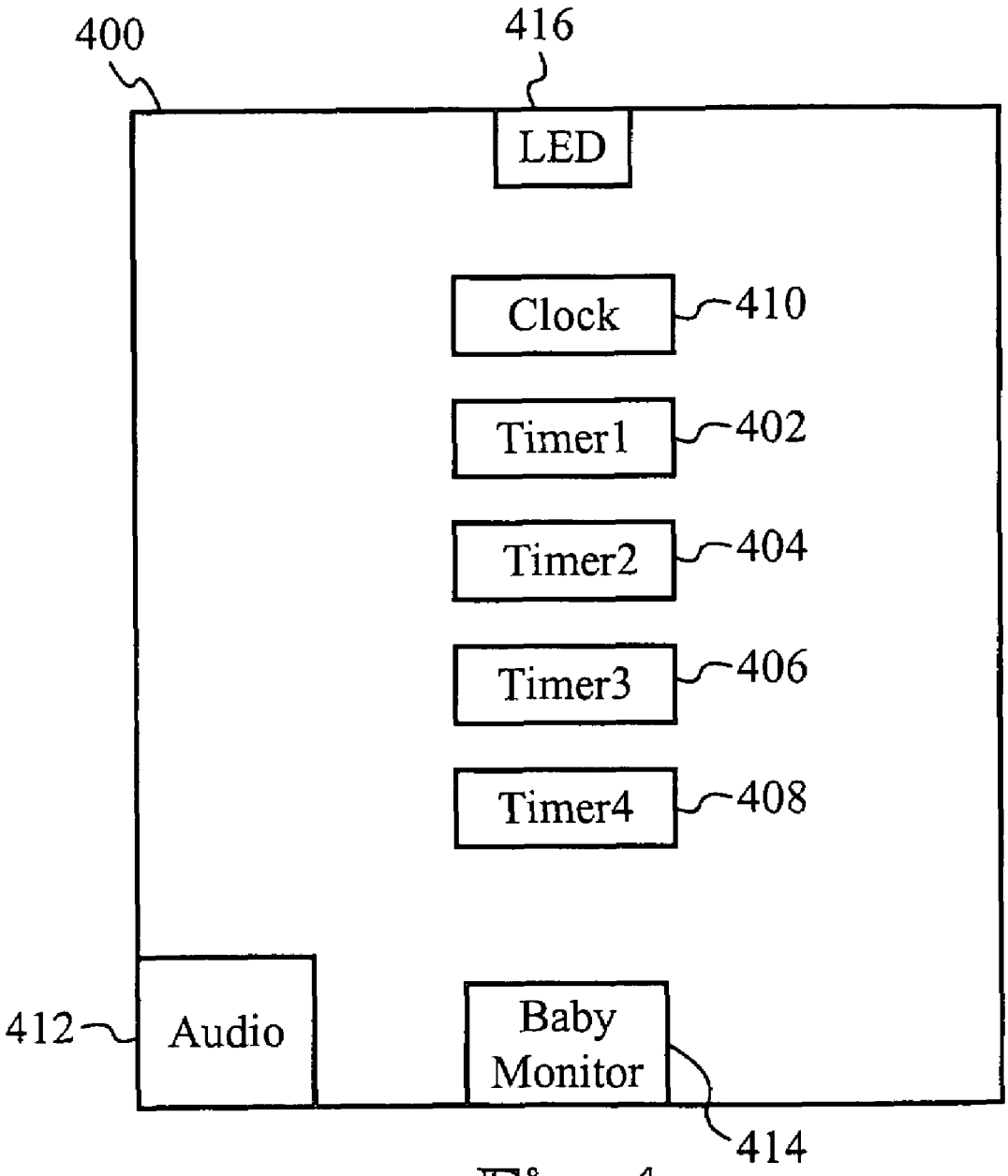
FIG. 4 illustrates a graphical representation of the internal components of an alternative embodiment of the present invention.

FIG. 4 illustrates a graphical representation of internal components of an alternative embodiment of the present invention. A timer device 400 includes a plurality of timers 402, 404, 406, 408 coupled to a plurality of displays (FIG. 1) and a plurality of buttons (FIG. 1). A clock timer 430 is also optionally included. Sounds, music, voices and other audio are able to be output from an audio output device 412. The audio output device 412 is triggered when an alarm setpoint is reached. In some embodiments, a baby monitor is incorporated to allow users to listen to their baby while not in close proximity. To implement the baby monitor, a receiver 414 is included within the timer device and a separate transmitter is positioned near the baby. Another addition includes a light source 416 positioned to provide light in the dark. In some embodiments, the light source 416 is a bright LED positioned to allow the timer device to function as a flashlight. In other embodiments, the light source 416 is a dim, diffused LED to allow the timer device to serve as a nightlight.

In other embodiments, additional features are included. An LCD backlight is able to illuminate the LCDs for a brief period of time so that the user is able to see the displays in the dark, thus not having to turn on the light and disturb the baby. Where multiple babies are monitored, such as twins, additional buttons are included to allow a user to select different baby profiles. In other embodiments, instead of a clip being used to attach the timer device to objects, a watch band is included so that a user is able to wear the timer device.

Additionally, another embodiment includes different audible alarms corresponding to each alarm setpoint. This is particularly useful for those with visual impairments. For example, if an elderly person with poor visibility is taking care of a grandchild, a certain tone, sound or music is able to be played when it is time for feeding. A sound such as "feed me" is played when it is time for feeding, and "change me" is played when it is time for a diaper change. Thus, the visual impairment does not affect the caretaker's ability to care for the baby.

In other embodiments, a vibration mechanism is utilized to alert the user that an alarm setpoint has been triggered.

To utilize the present invention a user determines if an alarm is to be set for any of the timers. Each timer has a corresponding button as well as a corresponding display. The corresponding button designates the function of that timer such as feeding, sleeping and diaper changes. The functions are designated either by an icon on the button and/or the button being appropriately shaped. Utilizing the button corresponding to the function being timed, a user is able to set an alarm setpoint. Each of the timers are able to store an individual alarm, so that the process of setting an alarm is repeated for each of the desired functions or events. After setting an alarm setpoint, the corresponding timer resets to 00:00 and begins counting up. Upon reaching the alarm setpoint, an audible alarm sounds and/or a visual indicator is triggered such as illuminating the corresponding button on the display. An alarm will not be triggered if it is not set or if it has been turned off. After an event occurs, such as after feeding the baby, a user resets the timer for that function by pressing-and-releasing the corresponding button. Furthermore, if feeding is by the breast, a mechanism is implemented to keep track of which breast, left or right, was last used. In the preferred embodiment, a clip is included so that the timer device is able to be kept readily accessible.

An example is disclosed herein to describe the present invention in operation. In the morning, a baby wakes up and has its diaper changed. The parent chooses to set the alarm setpoint for sleeping at three hours. The parent accomplishes setting the alarm by using the method described above of depressing and holding the corresponding button, until the display 106 is flashing. Here, the button 116 is the one with the sleeping icon. The button is then released. Next, the parent depresses the same corresponding button 116 to increment the alarm until the desired setpoint is reached. Finally, the parent waits for the timer 206 to resume the normal count-up process. The process of setting an alarm is repeated for each timer, so after the sleeping alarm is set, the diaper change alarm setpoint is set using the button corresponding to that timer. Here, the diaper change alarm is set for two hours using the aforementioned method. After half an hour, the baby becomes hungry. The mother uses her right breast to feed the baby and the feeding lasts for another half hour. Thus, the mother uses the indicator 126 to show that the right breast was used. Furthermore, the parent sets the feeding alarm setpoint for two hours using the process above and then the feeding timer resumes. At this point, the feeding display 104 indicates 00:00 as its timer has just been reset and has not reached one minute yet. The sleeping 106 and diaper change 102 displays both show roughly 01:00 as approximately one hour has passed since they were both set—half an hour passed before the baby became hungry and the feeding took half an hour. After another hour passes, the diaper change alarm is activated, and the visual and audio alarms alert the parent that it is time to change the baby again. Since the diaper change alarm setpoint was previously set, it does not have to be set again. All the parent must do is press the button 112 corresponding to diaper change once, and the timer 202 will reset. After another hour passes, both the feeding alarm and the sleeping alarm are activated. The mother uses her left breast this time and indicates this on the device. After feeding, the mother knows it is also time to have the baby sleep, since that alarm went off as well. After both tasks are accomplished, their respective buttons are depressed and the timers are restarted. The process repeats throughout the day and night as necessary. Using the timer device as described, the baby will never go an extended period of time without proper care. This example is for exemplary purposes only and is not meant to limit the invention in any way.

The present invention is not intended to replace parental responsibility. Although alarms are able to be set to indicate when a certain amount of time elapses, they are intended to be limits rather than a schedule of how to care for a baby. If a baby needs to be changed even though there is still an hour remaining before the alarm will be activated, the user should do so and then simply reset the diaper change timer afterwards. Moreover, since the timer device displays the time information for the different functions all at once, a use for the device is simply to monitor how daily events are going and to make schedule changes as necessary. For example, a user has a diaper change alarm setpoint set for three hours. However, the user also notices, by looking at the timer device, that occasionally an hour after feeding, the baby starts crying. Upon further investigation, the user determines the baby is crying because it is in need of diaper change. The user also notices the crying only occurs within one hour after feeding when the elapsed time for the diaper change is over an hour and a half. The astute user is able to determine that there is a direct correlation between the baby crying and it needing its diaper changed after eating when a diaper change has not occurred recently. Such a discovery would be more difficult to determine without the present invention because the necessary information would not be so readily available.

Numerous sequences of pressing the buttons corresponding to the timers are possible and are not limited to those described above. In alternative embodiments, to reset a timer, a user is required to press a button twice in rapid succession, similar to a double-click with a mouse on a computer. This prevents accidental resetting of the timers.

Although the present invention has been described for use with babies, the present invention is able to be used for people of any age or even pets. In particular, owners of puppies which have not been housebroken will benefit from knowing that it has been so many hours since the puppy last went to the bathroom and thus is able to preemptively let the dog outside.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A timer device for keeping track of human biological functions comprising:

a. a plurality of count timers specifying a set time interval, each operating in increments of minutes and/or hours;

b. a plurality of displays coupled to the plurality of timers for displaying information; and c. a plurality of buttons coupled to the plurality of displays and the plurality of timers for modifying the plurality of timers, wherein the plurality of buttons each represent a function.

2. The timer device as claimed in claim 1 further comprising a slide-switch on the timer device for indicating which breast was last used for feeding.

3. The timer device as claimed in claim 1 further comprising an apparatus for attaching the timer device to another object.

4. The timer device as claimed in claim 3 wherein the apparatus for attaching is a clip.

5. The timer device as claimed in claim 1 further comprising a wide bottom for enabling the timer device to stand upright.

6. The timer device as claimed in claim 1 wherein a first button of the plurality of buttons is shaped to represent feeding, a second button of the plurality of buttons is shaped to represent sleeping and a third button of the plurality of buttons is shaped to represent diaper changes.

7. The timer device as claimed in claim 1 wherein an icon of an object or an activity is on or near each of the plurality of buttons according to the function represented.

8. The timer device as claimed in claim 7 wherein a first icon represents feeding, a second icon represents sleeping and a third icon represents diaper changes.

9. The timer device as claimed in claim 1 wherein text is on or near each of the plurality of buttons according to the function represented.

10. The timer device as claimed in claim 1 wherein an alarm setpoint is selectively set within each of the plurality of timers for alerting a user.

11. The timer device as claimed in claim 10 wherein a button of the plurality of buttons corresponding to a timer of the plurality of timers of the alarm setpoint illuminates when the alarm setpoint is reached.

12. The timer device as claimed in claim 1 wherein an audible alarm sounds when an alarm setpoint is reached.

13. The timer device as claimed in claim 1 further comprising a flashlight light source.

14. The timer device as claimed in claim 1 further comprising a receiver for monitoring a baby's sounds.

15. The timer device as claimed in claim 1 further comprising a backlight for illuminating the plurality of displays in the dark.

16. The timer device as claimed in claim 1 wherein each single button of the plurality of buttons corresponds with a single timer of the plurality of timers and a single display of the plurality of displays.

17. The timer device as claimed in claim 1 wherein the plurality of displays are visible simultaneously.

18. The timer device as claimed in claim 1 wherein the plurality of displays are included within a single display device.

19. The timer device as claimed in claim 18 wherein the display device is a liquid crystal display device.

20. A hand-held timer device for keeping track of human biological functions comprising:

a. a plurality of up-count timers, each specifying a set time interval in increments of minutes and/or hours starting from 00:00;

b. a plurality of displays coupled to the plurality of timers for displaying time-related information;

c. a plurality of buttons coupled to the plurality of displays and the plurality of timers for modifying the plurality of timers, wherein the plurality of buttons each contain a feature representing a function; and d. an alarm setpoint corresponding to each of the plurality of timers for alerting a user when the alarm setpoint is reached.

21. The timer device as claimed in claim 20 further comprising a switch on the timer device for indicating which breast was last used for feeding.

22. The timer device as claimed in claim 20 further comprising an apparatus for attaching the timer device to another object.

23. The timer device as claimed in claim 22 wherein the apparatus for attaching is a clip.

24. The timer device as claimed in claim 20 further comprising a wide bottom for enabling the timer device to stand upright.

25. The timer device as claimed in claim 20 wherein the feature on each of the plurality of buttons is a shape of the button.

26. The timer device as claimed in claim 25 wherein a first button of the plurality of buttons is shaped to represent feeding, a second button of the plurality of buttons is shaped to represent sleeping and a third button of the plurality of buttons is shaped to represent diaper changes.

27. The timer device as claimed in claim 20 wherein the feature on each of the plurality of buttons is an icon of an object or an activity.

28. The timer device as claimed in claim 27 wherein a first icon represents feeding, a second icon represents sleeping and a third icon represents diaper changes.

29. The timer device as claimed in claim 20 wherein the feature on each of the plurality of buttons is text.

30. The timer device as claimed in claim 20 wherein a button of the plurality of buttons corresponding to a timer of the plurality of timers of the alarm setpoint illuminates when the alarm setpoint is reached.

31. The timer device as claimed in claim 20 wherein an audible alarm sounds when the alarm setpoint is reached.

32. The timer device as claimed in claim 20 further comprising a flashlight light source.

33. The timer device as claimed in claim 20 further comprising a receiver for monitoring a baby's sounds.

34. The timer device as claimed in claim 20 further comprising a backlight for illuminating the plurality of displays in the dark.

35. The timer device as claimed in claim 20 wherein each single button of the plurality of buttons corresponds with a single timer of the plurality of timers and a single display of the plurality of displays.

36. The timer device as claimed in claim 20 wherein the plurality of displays are visible simultaneously.

37. The timer device as claimed in claim 20 wherein the plurality of displays are included within a single display device.

38. The timer device as claimed in claim 37 wherein the display device is a liquid crystal display device.

39. A method of utilizing a timer device for keeping track of human biological functions comprising:

a. selectively setting one or more alarm setpoints on a plurality of count timers specifying a set time interval, each timer corresponding to an event and operating in increments of minutes and/or hours, wherein the plurality of count timers are set using a plurality of buttons each representing a function;

b. monitoring a plurality of displays each corresponding to a count timer to determine how much time passed since each of the events; and c. individually resetting the plurality of count timers after the corresponding event occurs.

40. The method as claimed in claim 39 wherein setting the one or more alarm setpoints further comprises:

i. pressing one of the plurality of buttons;

ii. holding the button for a period of time;

iii. releasing the button; and iv. press-and-releasing the button until a desired alarm setpoint is reached.

41. The method as claimed in claim 39 further comprising indicating which breast was last used for feeding using a slide-switch.

42. The method as claimed in claim 39 wherein a button corresponding to each timer is shaped representing an event and is used for selectively setting the one or more alarm setpoints and for individually resetting the timers.

43. The method as claimed in claim 39 wherein a button corresponding to each timer contains an icon and is used for selectively setting the one or more alarm setpoints and for individually resetting the timers.

44. A timer device for keeping track of human biological functions comprising:

a. a plurality of count timers specifying a set time interval, each operating in increments of minutes and/or hours;

b. a plurality of displays coupled to the plurality of timers for displaying information; and c. a plurality of buttons coupled to the plurality of displays and the plurality of timers for modifying the plurality of timers, wherein the plurality of buttons each represent a function, and further wherein each of the plurality of buttons are shaped according to the function represented.

45. A timer device for keeping track of human biological functions comprising:

a. a plurality of up-count timers specifying a set time interval, each operating in increments of minutes and/or hours;

b. a plurality of displays coupled to the plurality of timers for displaying information; and c. a plurality of buttons coupled to the plurality of displays and the plurality of timers for modifying the plurality of timers, wherein the plurality of buttons each represent a function.

46. A timer device for keeping track of human biological functions comprising:

a. a plurality of count timers specifying a set time interval, each operating in increments of minutes and/or hours;

b. a plurality of displays coupled to the plurality of timers for displaying information;

c. a plurality of buttons coupled to the plurality of displays and the plurality of timers for modifying the plurality of timers, wherein the plurality of buttons each represent a function; and d. a slide-switch for indicating which breast was last used for feeding.

* * * * *